United States Patent [19]

Campagna

[11] 4,296,617

[45] Oct. 27, 1981

[54] LOCKABLE KEY HOLDING RECEPTACLE

[75] Inventor: Barry A. Campagna, Oak Park, Mich.

[73] Assignee: Teledyne Industries, Inc., Los Angeles, Calif.

[21] Appl. No.: 101,455

[22] Filed: Dec. 10, 1979

[51] Int. Cl.[3] ..... E05B 65/52

[52] U.S. Cl. ..... 70/63; 70/371; 109/50

[58] Field of Search ..... 70/63, 158, 159, 160, 70/161, 163, 164, 165, 166, 167, 168, 170, 171, 172, 229, 231, 232, 371; 109/50, 51, 52

[56] References Cited

U.S. PATENT DOCUMENTS

| | | | |
|---|---|---|---|
| 1,590,007 | 6/1926 | West | 109/50 |
| 1,885,692 | 11/1932 | Dugan | 109/51 |
| 2,139,909 | 12/1938 | Park | 109/52 |

FOREIGN PATENT DOCUMENTS

| | | | |
|---|---|---|---|
| 1292033 | 4/1969 | Fed. Rep. of Germany | 70/63 |
| 998880 | 9/1951 | France | 109/50 |

*Primary Examiner*—Robert L. Wolfe

*Attorney, Agent, or Firm*—Gifford, VanOphem, Sheridan & Sprinkle

[57] ABSTRACT

A high security receptacle for a key is provided which is attachable to a door or like structure having an interior surface and an exterior surface. The receptacle comprises an elongated cylindrical housing having a length greater than the width of the door and a longitudinally extending cavity formed in the housing and which is open only through one axial end of the housing. The housing is positioned through a like shaped aperture formed through the door so that the open end of the housing faces outwardly from the exterior flush surface of the door while a portion of the housing protrudes radially inwardly from the interior surface of the door. A radially extending flange on the housing is secured to the door and has a surface which flatly abuts against the interior surface of the door and is secured to it by conventional threaded fasteners. A key is positioned within the interior of the cavity and, thereafter, the open end of the cavity is closed by a closure plug. A lock carried by the closure plug permits the closure plug to be removed from the housing only by authorized personnel.

8 Claims, 5 Drawing Figures

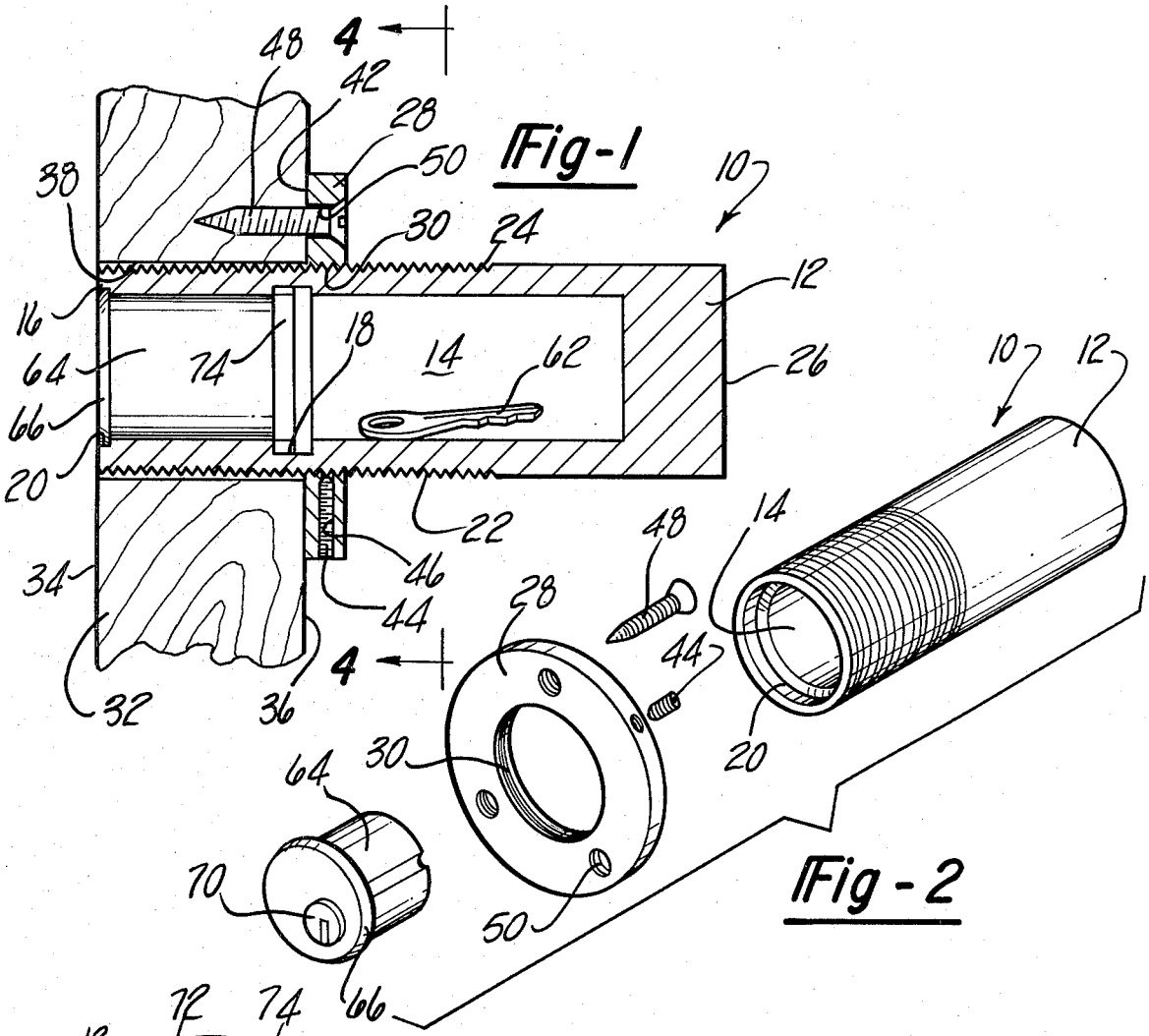
Fig-1
Fig-2
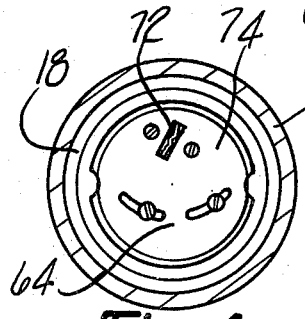
Fig-4
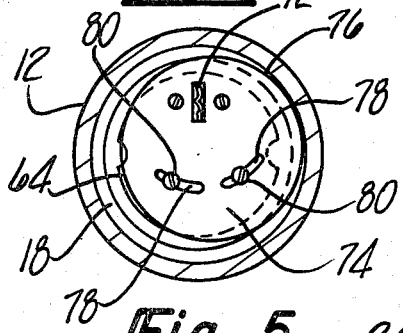
Fig-5
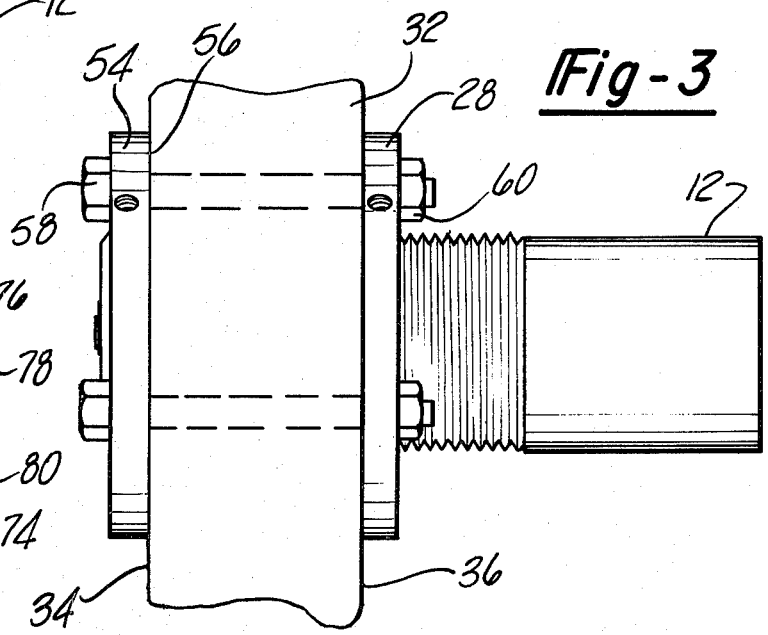
Fig-3

LOCKABLE KEY HOLDING RECEPTACLE

BACKGROUND OF THE INVENTION

I. Field of the Invention

The present invention relates generally to lockable receptacles and, more particularly, to a high security lockable receptacle for a key and which is designed to be attached to a door or like structure.

II. Description of the Prior Art

In the event of a fire, particularly at commercial establishments, it is necessary for the fire officials or firemen to rapidly gain access to the interior of the building in order to extinguish the fire. This is particularly true for commercial establishments, such as chemical companies, where the potential damage from such a fire is particularly hazardous not only to the commercial establishment but also to the surrounding area.

In order to ensure access to the building when it is unoccupied, it has been the previous practice for such business establishments to deposit a key to their building establishment with the fire department. Such keys are maintained at the fire station by the fire department on a ring or other suitable holder. Thus, in the event of a fire, the fire officials bring the key ring with the attached keys to the scene of the fire and, utilizing the appropriate key, gain access to the building establishment.

This previously known procedure for ensuring access by the fire department to a building establishment, however, as disadvantageous in a number of different respects. First, this prior practice is disadvantageous in that a large number of business establishments who have deposited keys with the fire department oftentimes reside within the zone or area of a single fire station. Thus, it is necessary for the fire officials to sort through the multiple keys in order to find and identify the correct key for a given business establishment. While the search for the appropriate key takes only a matter of minutes, in the event of a fire, a few minutes can be critical. Likewise, it is necessary for the Fire Department Emergency Medical Services to gain quick access into convelenscent homes, senior citizen high-rises, nursing homes, hospitals and the like to give immediate medical treatments.

A still further disadvantage of this previously known practice of deposition keys with the first station is that two separate fires frequently occur within the same zone or area of a given fire station. In this event, it is necessary for the firemen answering the second or later fire call to first travel to the scene of the first fire in order to pick up the key ring to gain access to the building establishment of the second fire. As before, such procedure is time consuming and oftentimes critical in the event of a fire.

Oftentimes, however, the Fire Department destroys the door, windows or the like to gain access to a fire. Such action, however, is disadvantageous in that it precludes the Fire Department from relocking the premises after the fire is extinguished or in the event of a false alarm. Moreover, this causes extensive damage to the premises.

SUMMARY OF THE PRESENT INVENTION

The present invention overcomes the above mentioned disadvantages of the prior practice of depositing keys with the fire station by providing a high security lockable key holding receptacle attachable to the door or like structure of a business establishment. A single key, or copies of this key, is operable to open all of the receptacles while a key to the particular business establishment is contained within the receptacles thus permitting access by the firemen to the establishment.

In brief, the receptacle according to the present invention comprises an elongated cylindrical housing having an interior cylindrical cavity which is open through one axial end of the housing. The housing has a length greater than the width of the door at the building establishment and is positioned through a like shaped aperture in the door so that the open end of the housing faces flush outwardly from the exterior door surface. Simultaneously, a portion of the housing protrudes radially inwardly from the interior surface of the door.

A radially outwardly extending flange is secured to the outer periphery of the housing and has one surface which flatly abuts against the interior surface of the door. This flange, and thus the housing, is then secured to the interior surface of the door by suitable fasteners, such as bolts or screws. Since the flange is greater in cross-sectional shape than the aperture formed through the door, the flange simply but effectively prevents extraction of the housing through the door aperture by unauthorized personnel.

A key to the business establishment is then positioned within the interior cavity of the housing. Thereafter, a closure plug having a lock is positioned within and closes off the open axial end of the cavity. Upon rotation of the lock via the key maintained by the fire department, a detent on the plug enters an annular groove formed around the housing cavity and thus prevents extraction of the closure plug by unauthorized personnel. Conversely, the fire department can rapidly gain access to the key contained with the cavity by inserting the fire department key into the lock, rotating the lock until the detent is moved out of the cavity groove and thereafter removing the closure plug.

The lockable key holding receptacle according to the present invention is thus advantageous in that a single key, or copies thereof, held by the fire department is sufficient to gain access to a plurality of business establishments and without the necessity of maintaining an individual key for each business establishment. Moreover, since the fire department can maintain several copies of the key necessary to open the receptacle of the present invention, in the event of multiple fires the previously known necessity of traveling to the first fire in order to obtain the key ring is completely eliminated.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a fragmentary longitudinal sectional view showing the key holding receptacle according to the present invention;

FIG. 2 is an exploded perspective view showing the key holding receptacle according to the present invention;

FIG. 3 is a fragmentary side view showing the key holding receptacle according to the present invention and illustrating a modified form of mounting the key holding receptacle;

FIG. 4 is a cross-sectional view taken substantially along line 4—4 in FIG. 1 and with the detent in an unlocked position; and FIG. 5 is a cross-sectional view similar to FIG. 4 but showing the detent in a locked position.

DETAILED DESCRIPTION OF A PREFERRED EMBODIMENT OF THE PRESENT INVENTION

With reference first to FIGS. 1 and 2, the high security key holding receptacle 10 according to the present invention is thereshown and comprises an elongated cylindrical housing 12 having an elongated and longitudinally extending cavity 14 formed in the housing 12. The cavity 14 is cylindrical in cross section and is open through only one axial end 16 of the housing 12. An annular groove 18 is formed in the housing 12 and extends radially outwardly from the cavity 14 at a position spaced from the open end 16 of the housing 12. Similarly, a further annular groove 20 is formed in the housing 12 and extends radially outwardly from the cavity 14 at the open end 16 of the cavity 14. The purpose of the grooves 18 and 20 will be subsequently described.

The housing 12 includes external threads 22 formed about its outer periphery and these external threads 22 extend from the open end 16 of the housing and to a point 24 short of the opposite axial end 26 of the housing 12. An annular flange or ring 28 with a central and internally threaded throughbore 30 threadably engages and cooperates with the external threads on the housing 22. Although the ring 28 is shown as annular in shape, it may be of any other convenient shape, such as square, provided that it has a central and internally threaded throughbore 30.

Referring now particularly to FIG. 1, the key holding receptacle 10 is adapted to be mounted to a door 32 or like structure having an exterior surface 34 and an interior surface 36. A throughbore 38 having a diameter at least as great as the diameter of a housing 12 is formed through the door 32 and a portion of the housing 12 is then positioned within the throughbore 38 so that its open end 16 faces outwardly from the exterior surface 34 of the door 32. The housing 12, moreover, has an axial length greater than the width of the door 32 so that another portion of the housing 12 protrudes inwardly from the door interior surface 36.

The axial position of the ring 28 along the housing 12 is, of course, adjustable by rotating the ring 28. Preferably, the ring 28 is axially positioned along the housing 12 so that the housing open end 16 is substantially flush with the exterior surface 34 of the door 32 and so that, simultaneously, one surface 42 of the ring 28 flatly abuts against the door interior surface 36. When the ring 28 is properly positioned, a set screw 44 threadably positioned in a radially extending bore 46 in the ring 28 is tightened so that the inner end of the set screw 44 abuts against the outer periphery of the housing 12 and prevents further rotation of the ring 28.

Positioning the end 16 of the housing 12 so that it is flush with the exterior surface 34 of the door 32 is highly desirable in that it prevents or at least inhibits tampering with the receptacle 10 by unauthorized personnel.

Still referring to FIG. 1, the ring 28 is then secured to the interior surface 36 of the door 32 by suitable fasteners 48, such as screws, which extend through axial apertures 50 in the ring 28 and into the door 32. Preferably one-way screws are used.

Since the cross-sectional area of the ring 28 is greater than the door throughbore 38, it is impossible for an unauthorized person to forcibly extract the housing 12 with the attached ring 28 through the door throughbore 38 from the outside of the door 32 without virtually destroying the door 32. Similarly, since the external threads 22 on the housing 12 terminate short of the housing inner axial end 26, it is impossible for an unauthorized person to unscrew the housing 12 exteriorly out through the door throughbore 38.

Referring now to FIG. 3, an alternative means for securing the housing 12 to the door 32 is thereshown in which an additional ring 54 is screwed onto the housing 12 and so that one surface 56 of the second ring 54 flatly abuts against the exterior surface 34 of the door 32. The rings 54 and 28 are tightened together thus sandwiching the door 32 in between them. Bolts 58 then extend through registering apertures in the rings 54 and 28 and threadably engage suitable nuts 60. Upon tightening the bolts 58, the rings 54 and 28, and thus the housing 12, are securely mounted to the door 32. It will also be appreciated that, in the event that an unauthorized person removes the bolts 58 and the outer ring 54, it would still be impossible to extract the housing 12 exteriorly through the door throughbore 38 since the first ring 28 is still attached to the housing 12. Moreover, the modified means for mounting the housing 12 to the door 32 shown in FIG. 3 is particularly adapted for metal doors and the like where the screw mounting shown in FIG. 1 would be unsuitable.

Referring now to FIGS. 1, 2 and 4, a key 62 is positioned within the cavity 14 and, thereafter, a cylindrical closure plug 64 is positioned within and closes the open end of the cavity 14. The closure plug 64 includes an enlarged diameter portion 66 at its outer end which fits within the housing groove 20 to limit the insertion of the plug 64 into the housing cavity 14 and also so that the closure plug 32 is flush with the housing end 16 to minimize or prevent tampering.

Still referring FIGS. 1, 2, 4 and 5, a key operated lock 70 is carried by the closure plug 64 and, upon rotation of the lock 70 by the proper key 72 rotates a circular lock detent 74 at the inner end of the closure plug 64 between an unlocked position, shown in FIG. 4, and a locked position shown in FIG. 5. In its locked position (FIG. 5) the detent 74 registers with and enters the annular groove 18 and prevents removal of the closure plug 64 from the housing 12. Conversely, upon the opposite rotation of the lock 70, the detent 74 rotates out of the housing groove 18 (FIG. 4) and enables the extraction of the closure plug 64 from the housing 12.

The closure plug 64 with the lock 70 installed is commercially available and is called a lock cylinder. Moreover, since a standard lock cylinder is used, the present invention can be adapted to any key system.

As previously set forth, the detent 74 is preferably circular in shape. Thus, upon partial rotation of the detent 74, a relatively long edge 76 of the detent 74 enters the groove 18 thus firmly locking the closure plug 64 to the housing 12. In addition, the detent 74 includes a pair of arcuate slots 78 while a screw 80 having an enlarged head extends through each slot 78 and is threadably secured to the closure plug 64. The screws 80 slide along the slots 78 as the detent 74 is rotated and render the forcible extraction of the closure plug 64 from the housing cavity 14 virtually impossible.

Since the housing groove 18 extends entirely around the cavity 14, the closure plug 32 can freely rotate with respect to the housing 12 even when the plug 32 is locked to the housing 12. This is advantageous in that it renders the lock 70, virtually tamper proof, in conjunction with the other design features of my device.

Although the operation of the key holding receptacle 10 according to the present invention should by now be apparent, it will be summarized in the interest of clarity. The housing 12 is first secured to the door 32 of a business establishment, or the like, by the screws 48 or the bolts 58 as the case may be. Thereafter, a key 62 to the business establishment is positioned within the cavity 14 and the plug 64 is inserted within the cavity 14 and locked to the housing 12. Within a given area, typically the district covered by a particular fire department, a given key will open all of the locked cylinders 70. This key, and any copies thereof, is maintained by the fire department.

In the event of a fire, the fire department utilizes its key to open the locked cylinder 70 and remove the closure plug 64 thus gaining access to the key 62 contained within the housing cavity 14. The fire department then utilizes this key to gain access to the business establishment in order to extinguish the fire.

After the fire department has gained access to the business establishment, the key 62 is returned to the housing cavity 14 and the closure plug 64 is relocked to the housing 12. Thus, within a single fire district, only a single key is required in order to gain access to the various business establishments without any destruction of the premises.

The present invention is further advantageous in that it provides a high security, i.e. tamper proof, key holding receptacle. Moreover, the receptacle is preferably conveniently located near the door lock so that it can be rapidly located and opened by authorized personnel.

The provision of a circular detent to render forcible extraction of the lock cylinder impossible also forms a novel feature of the invention.

Having described my invention, however, many modifications thereto will become obvious to those skilled in the art to which it pertains without deviation from the spirit of the invention as defined by the scope of the appended claims.

I claim:

1. A receptacle for a key, said receptacle being attachable to a door or like structure having an interior surface and an exterior surface, said receptacle comprising:

an elongated housing having a length greater than the width of said door, said housing having a longitudinally extending cavity which is open through only one axial end of the housing, said housing being positioned through an aperture in said door so that the open end of said housing faces outwardly flush from the exterior surface of said door so that a portion of the housing protrudes radially inwardly from the interior surface of the door;

means for attaching said housing to the interior surface of said door;

a closure plug receivable within the open axial end of said housing; and means for removably locking said plug to said housing wherein said cavity is circular in cross-sectional shape and has a circumferentially extending groove formed about its inner periphery at a position spaced from said open end of the housing, and wherein said means for locking said plug to said housing comprises a lock cylinder having a detent a portion of which enters said groove upon rotation of said lock cylinder.

2. The invention as defined in claim 1 wherein said attaching means further comprises a flange secured to and extending outwardly from said housing, said flange having a surface lying in a plane substantially parallel to the interior surface of said door and at least one threaded fastener extending through said flange and into said door.

3. The invention as defined in claim 2 wherein said housing is cylindrical in shape, a portion of said housing having external threads, and wherein said flange includes an internally threaded bore which threadably cooperates with the threaded housing portion so that rotation of said flange with respect to the housing varies the position of the open end of the housing with respect to the exterior surface of the door.

4. The invention as defined in claim 3 wherein said housing threaded portion extends from the open end of said housing and to a point short of the other end of the housing.

5. The invention as defined in claim 3 and including means for locking said flange to said housing at a longitudinal variable position along the housing.

6. The invention as defined in claim 5 wherein said flange includes a radially extending throughbore open at one end to said flange bore and wherein said means for locking said flange to said housing comprises a threaded member threadably positioned in said throughbore and which, upon tightening, abuts against said housing.

7. The invention as defined in claim 1 wherein the detent includes a semicircular edge which enters said groove upon rotation of said lock cylinder, said semicircular edge having a radius substantially the same as the radius of said housing cavity.

8. The invention as defined in claim 7 wherein said detent has at least one arcuate slot formed through it and wherein a threaded member having an enlarged head is slidably positioned through said detent slot and threadably engages said closure plug.

* * * * *